US012490845B2

(12) United States Patent
Shah et al.

(10) Patent No.: US 12,490,845 B2
(45) Date of Patent: Dec. 9, 2025

(54) CONNECTABLE BLANKET SECTIONS

(71) Applicants: Ami J. Shah, St. Austin, TX (US); Melissa H. Riggs, Owing Mills, MD (US)

(72) Inventors: Ami J. Shah, St. Austin, TX (US); Melissa H. Riggs, Owing Mills, MD (US)

( * ) Notice: Subject to any disclaimer, the term of this patent is extended or adjusted under 35 U.S.C. 154(b) by 0 days.

(21) Appl. No.: 18/654,991

(22) Filed: May 3, 2024

(65) Prior Publication Data

US 2025/0338982 A1 Nov. 6, 2025

Related U.S. Application Data

(63) Continuation-in-part of application No. 18/223,086, filed on Jul. 18, 2023, now abandoned.

(60) Provisional application No. 63/368,785, filed on Jul. 19, 2022.

(51) Int. Cl.
*A47G 9/02* (2006.01)

(52) U.S. Cl.
CPC ..... *A47G 9/0223* (2013.01)

(58) Field of Classification Search
CPC .. A47G 9/0223; A47G 9/0261; A47G 9/0207; A47G 9/02
See application file for complete search history.

(56) References Cited

U.S. PATENT DOCUMENTS 917,403 A * 4/1909 Benger ..... A47G 9/08 5/413 R
1,241,968 A * 10/1917 Hansen ..... A47G 9/0261 5/501
1,547,085 A * 7/1925 Tucker ..... A47G 9/0207 5/413 R
3,273,176 A * 9/1966 Millar ..... A47G 9/0207 5/486
3,508,285 A * 4/1970 Marquette ..... A47G 9/023 5/923
4,573,227 A * 3/1986 Prandina ..... A47G 9/0207 5/486
4,631,765 A * 12/1986 Casey ..... A47G 9/0207 428/33
4,878,258 A * 11/1989 Casey ..... A47G 9/0207 428/44
4,949,415 A * 8/1990 Selga ..... A47G 9/0284 428/102
5,330,806 A * 7/1994 Bythewood ..... A47G 9/062 428/53
5,592,691 A * 1/1997 Ronald ..... A41D 15/00 2/243.1
5,713,089 A * 2/1998 Ferrante ..... A47G 9/0207 5/923

(Continued)

*Primary Examiner* — Eric J Kurilla
(74) *Attorney, Agent, or Firm* — IP Works Law PLLC

(57) ABSTRACT

Connectable blanket sections are shown and described. The connectable blanket section includes a first layer of material secured to a second layer of material. At least one connector secured to at least one of the first layer of material or the second layer of material along one edge. At least one second connector secured to at least one of the first layer of material or the second layer of material secured along a connecting edge. The connectable blanket section is able to be secured to at least one additional blanket section to create a larger blanket.

6 Claims, 12 Drawing Sheets

(56) References Cited

U.S. PATENT DOCUMENTS 5,887,299 A * 3/1999 Phillips ..... A47G 9/086 5/413 R
5,924,132 A * 7/1999 Wigutow ..... A45F 4/14 2/69.5
5,970,541 A * 10/1999 Chiang ..... A47D 11/00 5/420
6,199,232 B1 * 3/2001 Kocivar ..... A47G 9/0207 5/413 R
6,443,794 B2 * 9/2002 Oren ..... A63H 33/00 446/85
8,015,637 B2 * 9/2011 Papen ..... A47D 15/003 5/482
8,214,947 B1 7/2012 Helton
8,950,023 B2 * 2/2015 Jacobsen ..... A47G 9/0223 5/482
9,980,591 B2 * 5/2018 Villano ..... A63F 9/0669
2004/0117909 A1 * 6/2004 Liao ..... A47C 15/008 5/663
2005/0144721 A1 * 7/2005 Linnane ..... A47G 9/0261 5/501
2006/0174409 A1 8/2006 Hermanson
2006/0179570 A1 * 8/2006 Schweigert ..... A47G 9/0207 5/482
2007/0245492 A1 10/2007 Combellick
2008/0289105 A1 * 11/2008 Ranzau ..... A47G 9/0223 5/482
2009/0294075 A1 * 12/2009 Huck ..... A63H 33/008 160/382
2010/0263122 A1 * 10/2010 Papen ..... A47G 9/0207 5/482
2012/0073048 A1 * 3/2012 Ballard ..... A47G 9/062 5/485
2014/0283722 A1 * 9/2014 Pinoli ..... D05B 97/12 112/117
2014/0317846 A1 * 10/2014 Collins ..... A47G 9/0207 5/486
2015/0305523 A1 * 10/2015 Zimmermann ..... A47G 9/066 5/486
2016/0192793 A1 * 7/2016 Cavosie ..... A47G 9/02 5/502
2018/0242762 A1 * 8/2018 Distefano ..... A47G 9/0223
2019/0059618 A1 * 2/2019 Jocic ..... A47G 9/04
2020/0128967 A1 * 4/2020 Cote ..... A47G 9/0238
2020/0315378 A1 * 10/2020 Cooley ..... B32B 7/02
2020/0323368 A1 * 10/2020 Shook ..... A47G 9/0261
2022/0087452 A1 * 3/2022 Kaya ..... A47G 9/0253
2022/0175159 A1 * 6/2022 Harvey, Jr. ..... A47G 9/0207
2022/0175160 A1 * 6/2022 Guy ..... A47G 9/0261
2022/0202211 A1 * 6/2022 Jung ..... A47G 9/04
2022/0256940 A1 * 8/2022 Hoshi ..... A47G 9/083
2023/0270268 A1 * 8/2023 Pham ..... A47G 9/0223 5/486

* cited by examiner

CONNECTABLE BLANKET SECTIONS

CROSS REFERENCE TO RELATED APPLICATIONS

This application claims the benefit of U.S. application Ser. No. 18/223,086 filed on Jul. 18, 2023 which claims the benefit of U.S. Provisional Application No. 63/368,785 filed on Jul. 19, 2022. The above identified patent application is herein incorporated by reference in its entirety to provide continuity of disclosure.

BACKGROUND OF THE INVENTION

The present invention relates to connectable blanket sections. More particularly, the present invention provides individual sections of a blanket which may be used individually as a blanket or connected together to create a larger blanket.

Currently nothing exists that allows a person to connect or disconnect sections of a blanket at will. Further, nothing exists that allows a person to adjust a blanket's size at will. This means that small children could outgrow their blankets very quickly. This could lead to the need to replace the blanket after a child is already attached to it.

Blankets have an insufficient lifespan. In the case of baby blankets, the covering device needs to withstand extensive use and continuous cleaning. Additionally, babies often develop emotional attachment to "Transitional Objects", also known as Security Blankets, as early as 3 months of age. Developing an attachment to a singular object, intended to offer comfort from infancy often through adulthood, places a burden on the object to sustain quality and utility over an extended period of time. Nothing currently exists that meets this burden in the realm of covering devices. This design concept ensures an ability for users to develop attachment to each of the identically sized connectable blanket sections and offers for all sections to be connected into a larger sized covering device. Additionally, it ensures durability of the blanket through physical growth of the user and the need for increasing bed sizes.

Further, nothing exists which has the same design. Each individual connectable blanket section can function as an independent blanket that can be used from early infancy in AAP approved manners. Multiple connectable blanket sections can be connected to form a larger blanket or covering device using snaps, zippers, hook and loop fasteners or other connecting devices.

Each individual connectable blanket section can be used as an independent entity. In one embodiment, to convert multiple sections of the connectable blanket into the larger version, multiple sections are turned inside out to reveal the side embellished with connectors. Joining the blankets via the complementary connection devices will allow the connectable blanket to scale to meet the needs of the user.

Consequently, there is a need for an improvement in the art of blankets and covering devices. The present invention substantially diverges in design elements from the known art while at the same time solves a problem many people face. In the case of baby blankets, caregivers struggle when attempting to give their child a blanket that will not only remain intact for years to come but also to be appropriately sized for an infant and be able to grow with the child.

SUMMARY OF THE INVENTION

The present invention provides connectable blanket sections wherein the same can be utilized for providing convenience for the user when in need of a blanket of different sizes or needing multiple identical blankets. The connectable blanket section includes a first layer of material secured to a second layer of material. At least one connector secured to at least one of the first layer of material or the second layer of material along one edge. At least one second connector secured to at least one of the first layer of material or the second layer of material secured along a connecting edge.

Another object of the connectable blanket section is to have the at least one connector be a plurality of snaps.

Another object of the connectable blanket section is to have the at least one connector be a hook and loop connector.

Another object of the connectable blanket section is to have the at least one connector be a zipper.

Another object of the connectable blanket section is to have the at least one connector be at least one button connector.

Another object of the connectable blanket section is to have an opening along one edge.

Another object of the connectable blanket section is to have at least one connector along the opening, wherein the connector will allow for the opening to be openably sealed closed.

Another object of the connectable blanket section is to have the opening along the one edge will allow for the connectable blanket section to be placed in an inside out configuration. In this configuration the at least one connector can be moved from the outside of the connectable blanket section to the interior of the connectable blanket section.

Another object of the connectable blanket section is to have the connectable blanket section be connected to at least one additional connectable blanket section in order to create a larger blanket.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
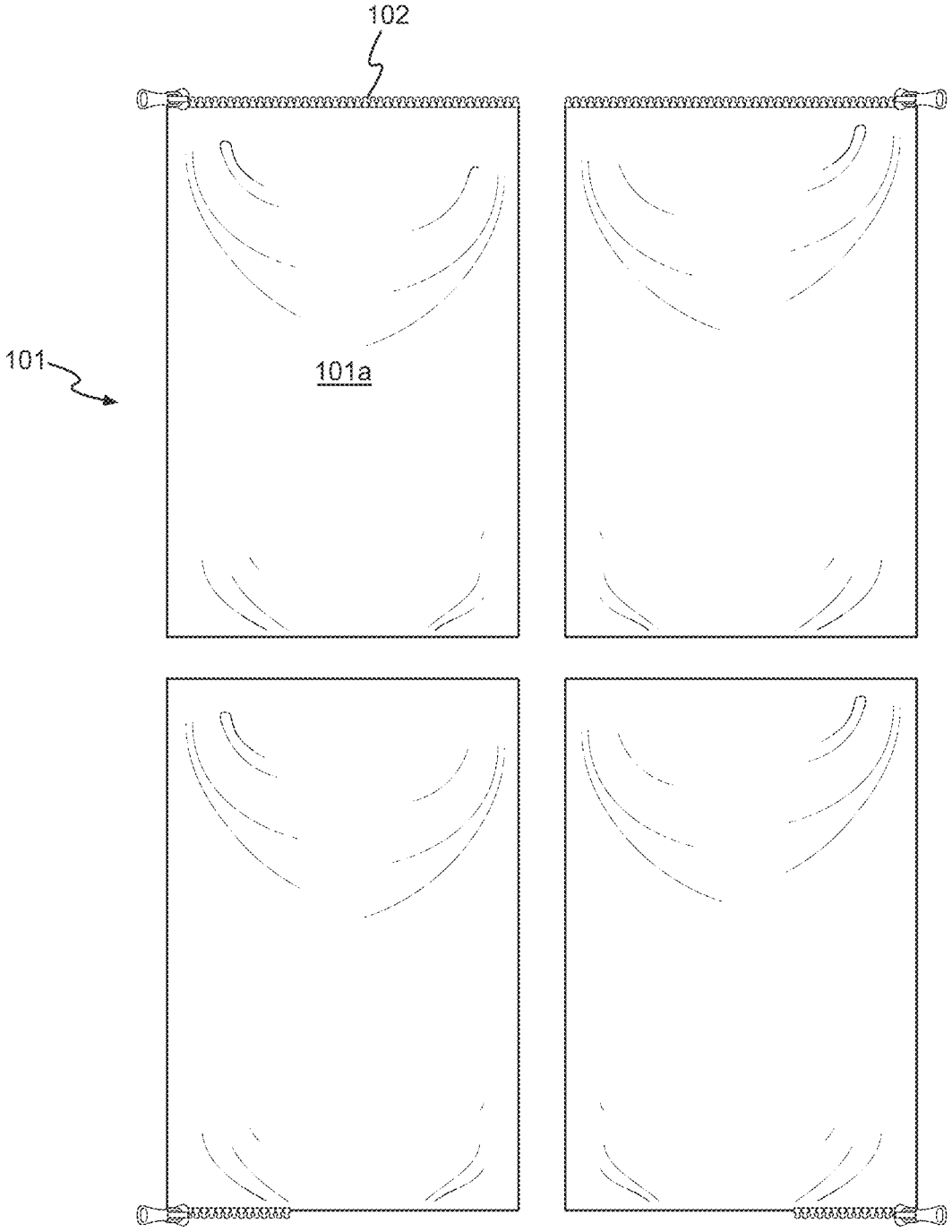
FIG. 1 shows a perspective view of one embodiment of a first side of four connectable blanket sections.
Figure 2A:
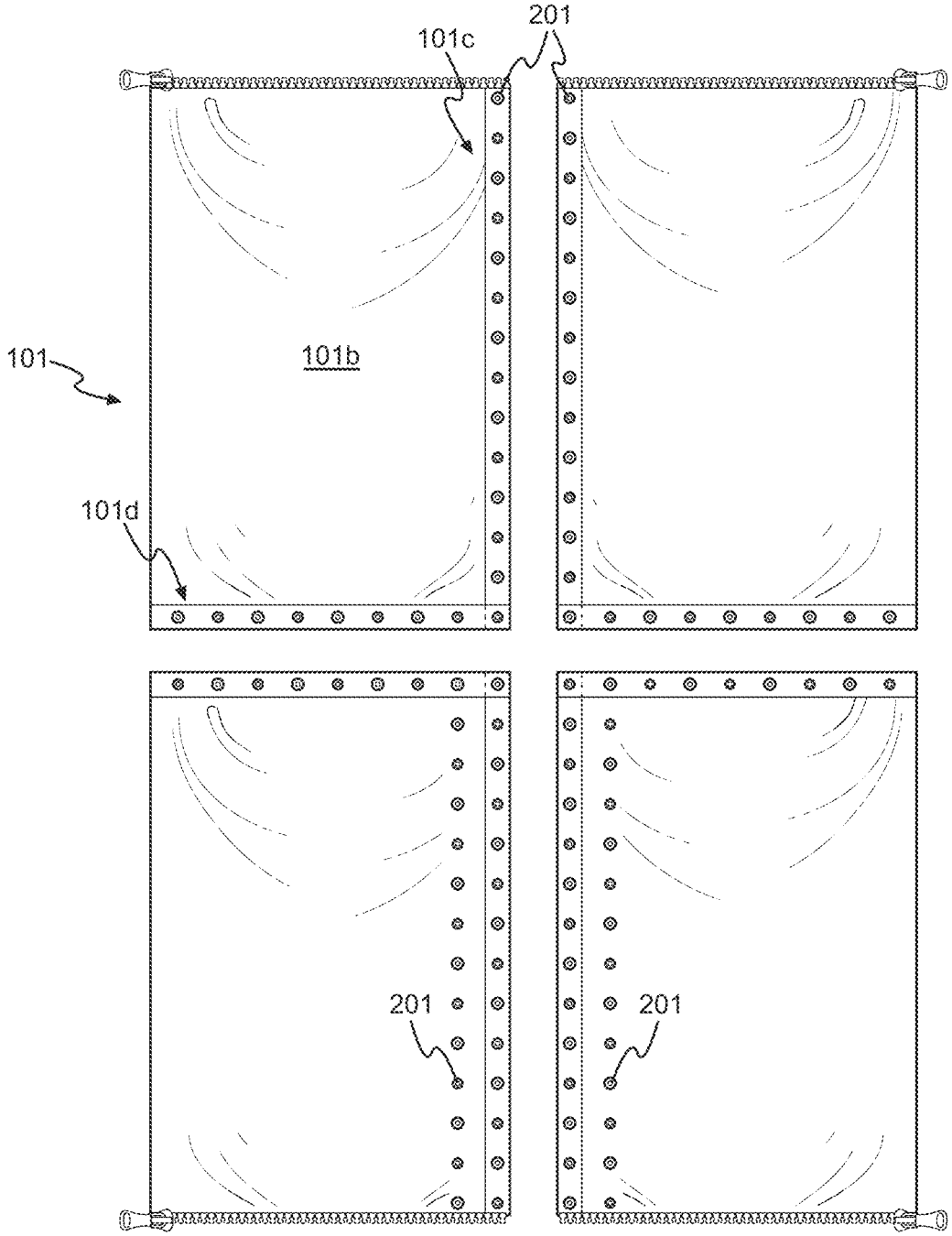
FIG. 2A shows perspective view of one embodiment of a second side of four connectable blanket sections having snap connectors.
Figure 2B:
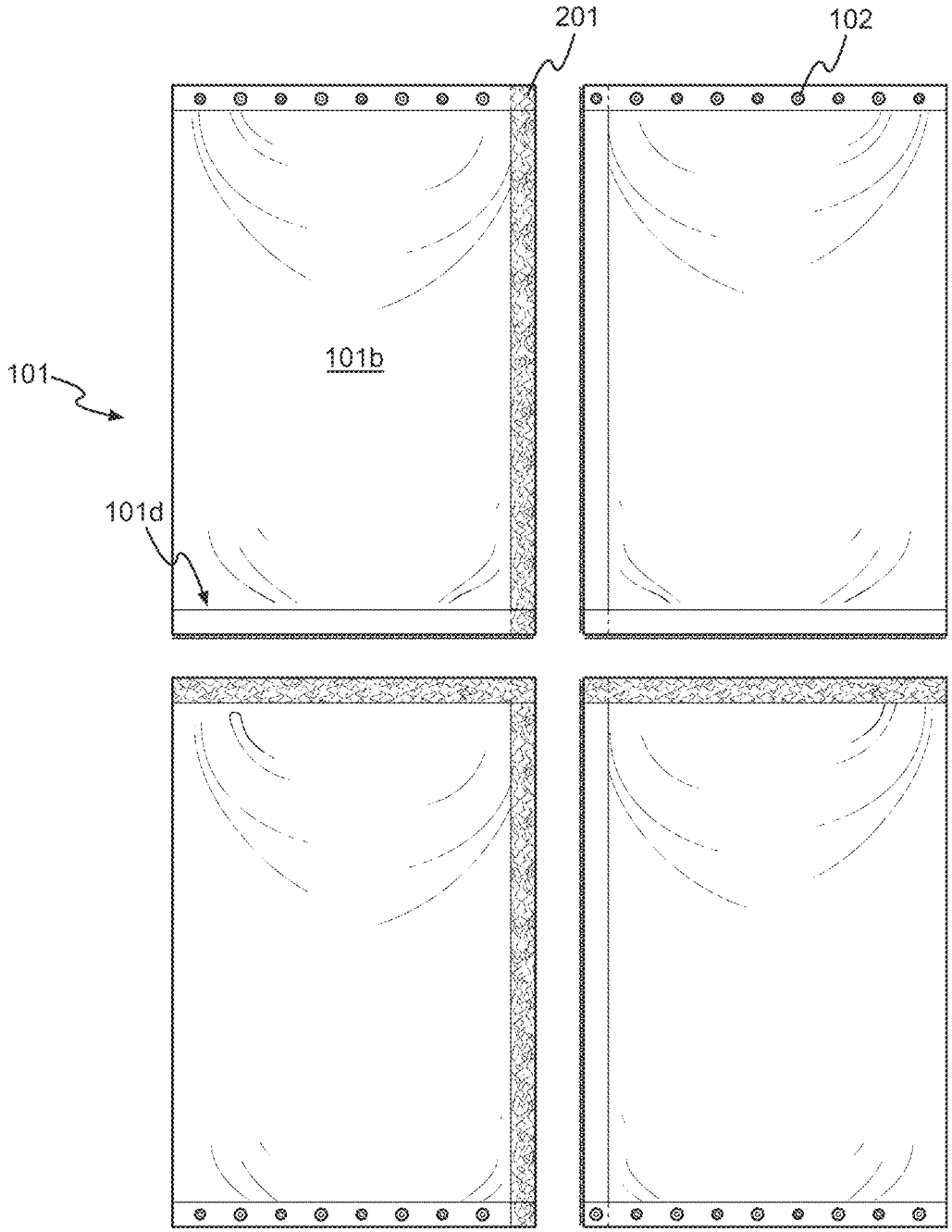
FIG. 2B shows a perspective view of one embodiment of a second side of four connectable blanket sections having hook and loop connectors.
Figure 2C:
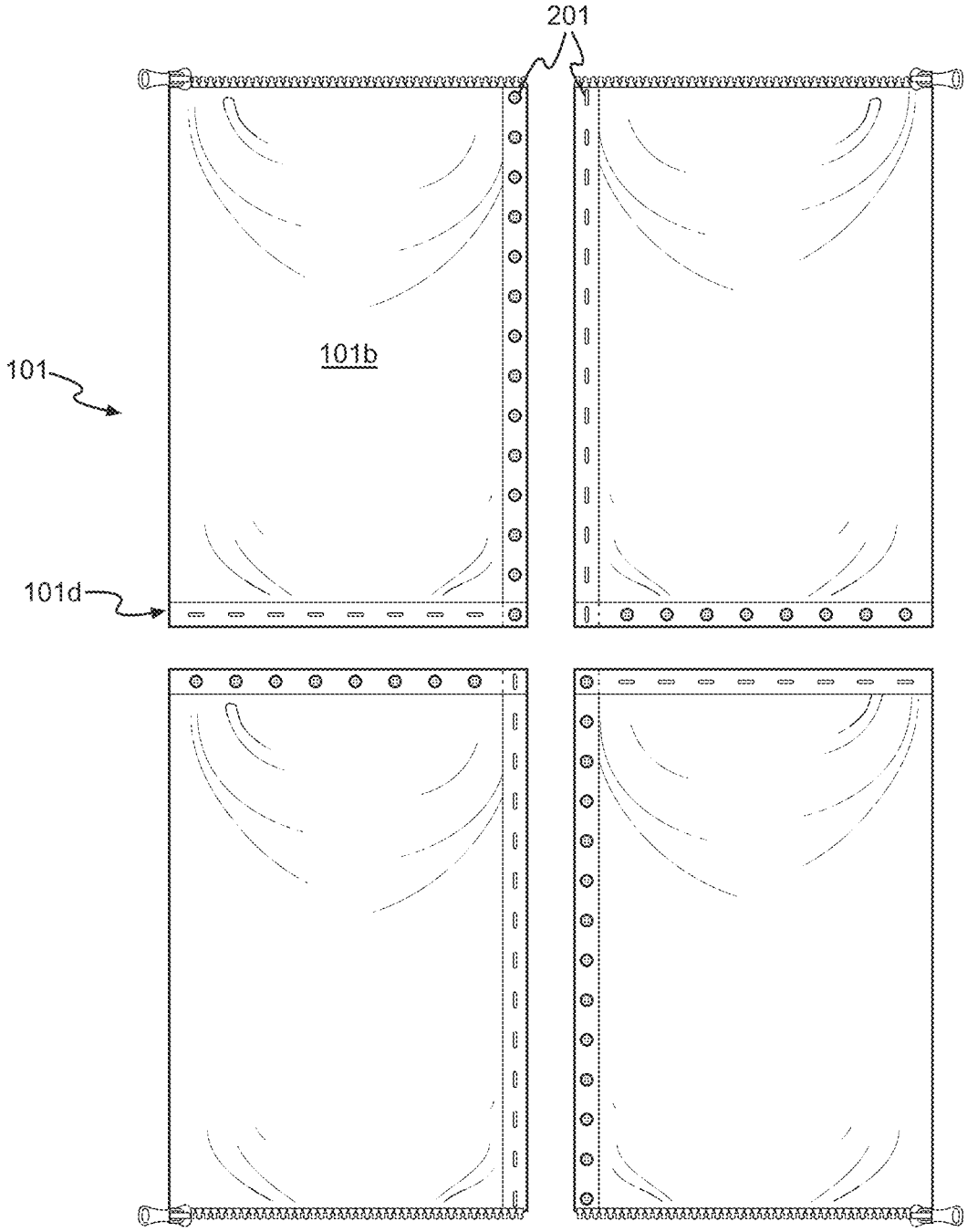
FIG. 2C shows a perspective view of one embodiment of a second side of four connectable blanket sections having button connectors and button holes.
Figure 2D:
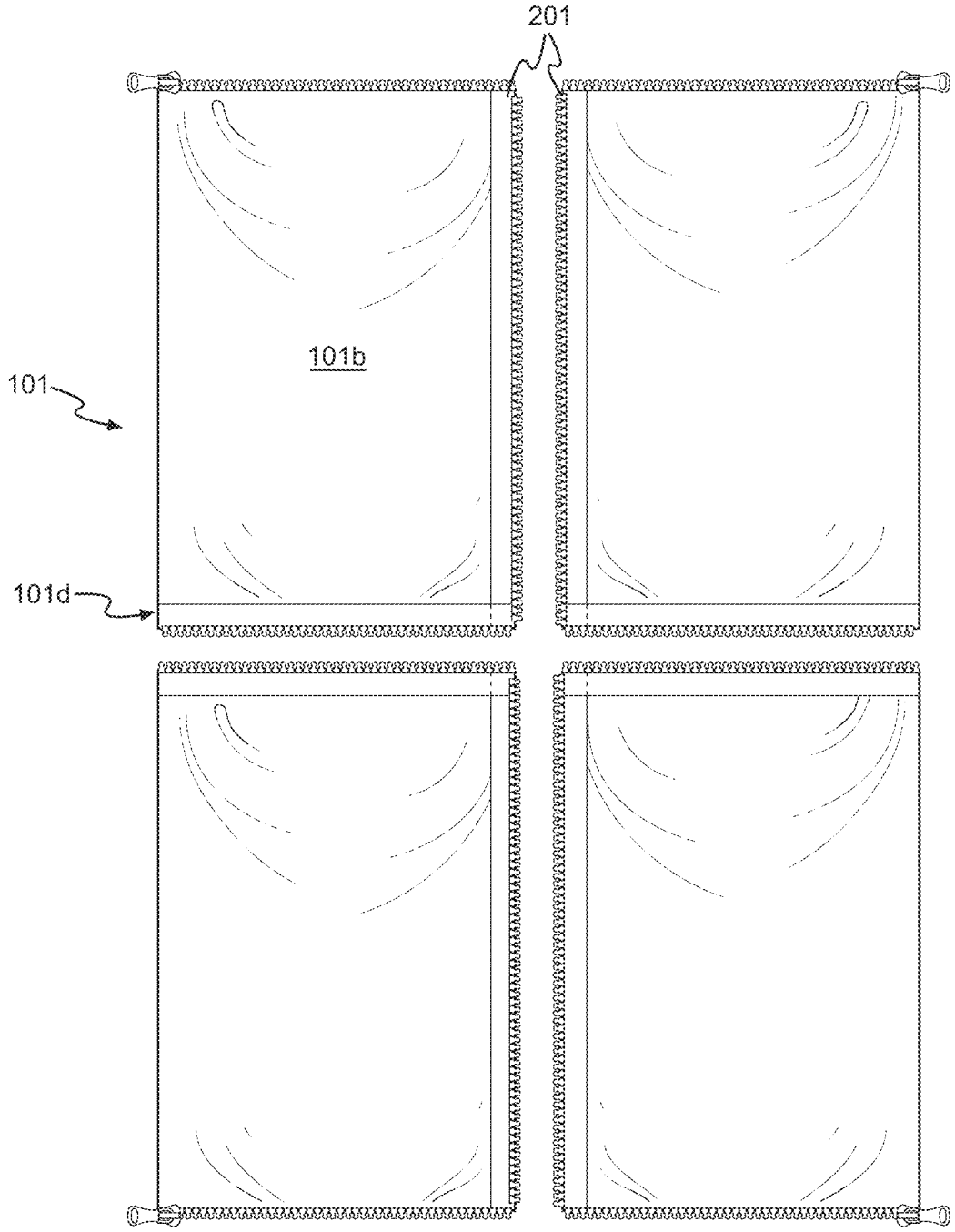
FIG. 2D shows a perspective view of one embodiment of a second side of four connectable blanket sections having zipper connectors.

With regard to the reference numerals used, the following numbering is used throughout the drawings.

| | |
|---|---|
| 101 | Connectable blanket section |
| 101a | First layer of material |
| 102 | Closure device |
| 101b | Second layer of material |
| 101c | First edge |
| 101d | Second edge |
| 201 | Connector(s) |
| 201a | First half of snap |
| 201b | Second half of snap |
| 301 | Flap(s) |
| 401 | Large connectable blanket |
| 402 | Material Layer |
| 403 | First connectable blanket section |
| 404 | Second connectable blanket section |
| 405 | Material Layer |

DETAILED DESCRIPTION OF THE INVENTION

Reference is made herein to the attached drawings. Like reference numerals are used throughout the drawings to depict like or similar elements of the connectable blanket sections. For the purposes of presenting a brief and clear description of the present invention, a preferred embodiment will be discussed as used for the connectable blanket sections. The figures are intended for representative purposes only and should not be considered to be limiting in any respect.

Referring now to FIG. 1, there is shown a perspective view of a first side of one embodiment of four connectable blanket sections. The connectable blanket sections 101 are comprised of a first layer of material 101*a* which can be seen from this view. The first layer of material 101*a* may be made from any number of suitable materials. Suitable materials may include, but are not limited to, hemp, soy, bamboo, wool, cotton, nylon, silk, felt, or polyester. In the shown embodiment each of the connectable blanket sections 101 are of the same size and shape. This will allow for the connectable blanket sections 101 to be connected together into a larger blanket as described herein.

Each connectable blanket section 101 includes a closure device 102 along one side. In the shown embodiment the closure device 102 is a zipper. However, any manner of different closure devices which still open and close access to the interior of the connectable blanket section 101. For example, the closure may be a magnet, a snap, a button, and other such functional closures. A zipper serves as a good closure device 102 because a zipper can be used in a reversable manner. This will be needed as described in the description of FIG. 3. Further, in some embodiments the closure device 102 does not extend along the full side. In these embodiment the closure will open a section of the one side while the rest of the side remains closed. The closure device 102 is not limited to any one side or location of the connectable blanket section 101. One of ordinary skill in the art will understand that the closure may be located in any number of locations and the functionality will remain the same.

Referring now to FIG. 2A-FIG. 2D, there is shown perspective views of a second side of various embodiments of connectable blanket sections having different connectors. This view shows the second layer of material which makes up the connectable blanket section 101. The second layer of material 101*b* may be made from any number of suitable materials. Suitable materials may include, but are not limited to, hemp, soy, bamboo, wool, cotton, nylon, silk, felt, or polyester.

From these views it is shown that each connectable blanket section 101 has at least one connector 201 shown along a first edge 101*c* of the connectable blanket section 101. Further, each blanket section 101 has at least one connector 201 located along a second edge 101*d* of the connectable blanket section 101. The connectors 201 are located along adjacent edges. This will allow for the connectable blanket sections 101 to be connected into a single larger blanket. For purposes of this disclosure several embodiments of connectors 201 have been shown. These embodiments include snaps, hook and loop, buttons, and zippers. However, in other embodiments connectors 201 may include, magnets, magic fasteners, and many others. One of ordinary skill in the art will understand that any type of connector may be used to secure the connectable blanket sections 101 together while not departing from the spirit of the present invention.

In many of the shown embodiments there is a single row of connectors 201 shown along each edge. However, in different embodiments multiple rows of connectors may be used. Single rows of connectors 201 are sufficient to hold the connectable blanket sections 101 together. However, in some instances multiple rows of connectors 201 will provide benefits to the connection of the connectable blanket sections 101. There is no limit to the number or configuration of the connectors 201 so long as the connectable blanket sections 101 may be secured together as desired.

In different embodiments different connectors 201 may be used. In one embodiment the connectors 201 are snaps. When using the snaps a first side of the snap shall be attached to one blanket section 101 and the second side of the snap shall be attached to a different blanket section 101. The correct blanket section shall be determined by the way the blanket sections will be connected. One of ordinary skill in the art will be able to determine where to properly place the snap halves in order to allow for the blanket sections 101 to be connected into a single larger blanket.

In another embodiment a hook and loop connector 201 is used. When using hook and loop for a connector 201 the hook and loop may be used in a multitude of ways. First, the hook and loop may be applied similar to the snaps. In this embodiment one part of the hook and loop is placed along a first blanket section 101 and a second part of the hook and loop will be placed on the desired blanket section 101. Second smaller sections of hook and loop may be used. This will allow for two options. A first part (either the hook or the loop) may be used on a first blanket section 101 and the opposing part will be added to the desired blanket section 101. In another embodiment some hooks and some loops may be applied to a first blanket section 101 and the opposite sections may then be properly applied to the second blanket section.

In another embodiment buttons and buttonholes may be used as connectors 201. In this embodiment similar to the others either the buttons or the holes may be located on one connectable blanket and the opposing part of the connector will be located a second desired blanket section.

In yet another embodiment a zipper may be used as the connector 201. When using a zipper, additional components may be needed to cover the zipper itself. This could present as additional material flaps used to cover the zipper once the connectable blanket sections 101 are secured together. In other embodiments various components are used to cover the connector 201.

Figure 3A:
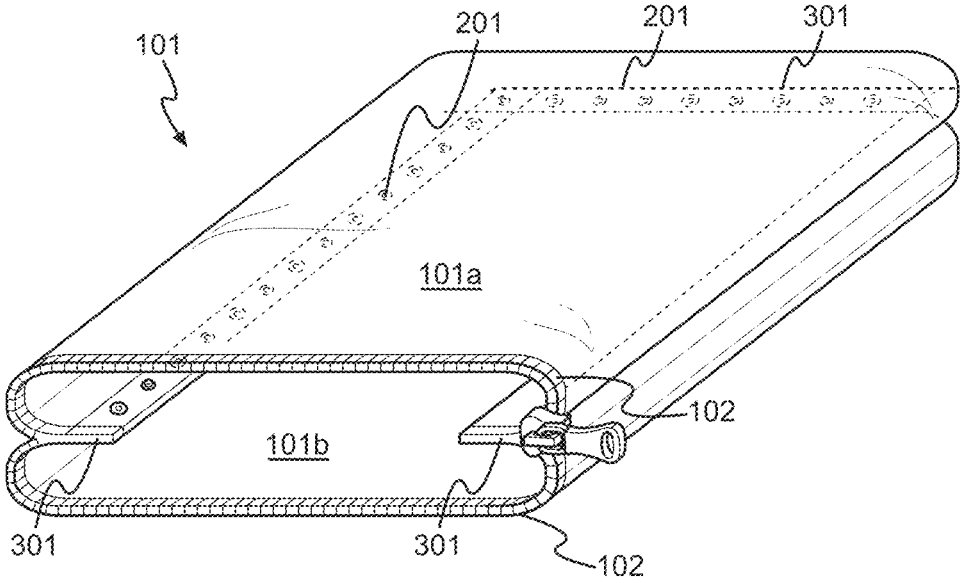
FIG. 3A shows a perspective view of one embodiment of one connectable blanket section having the connectors located on an interior thereof.
Figure 3B:
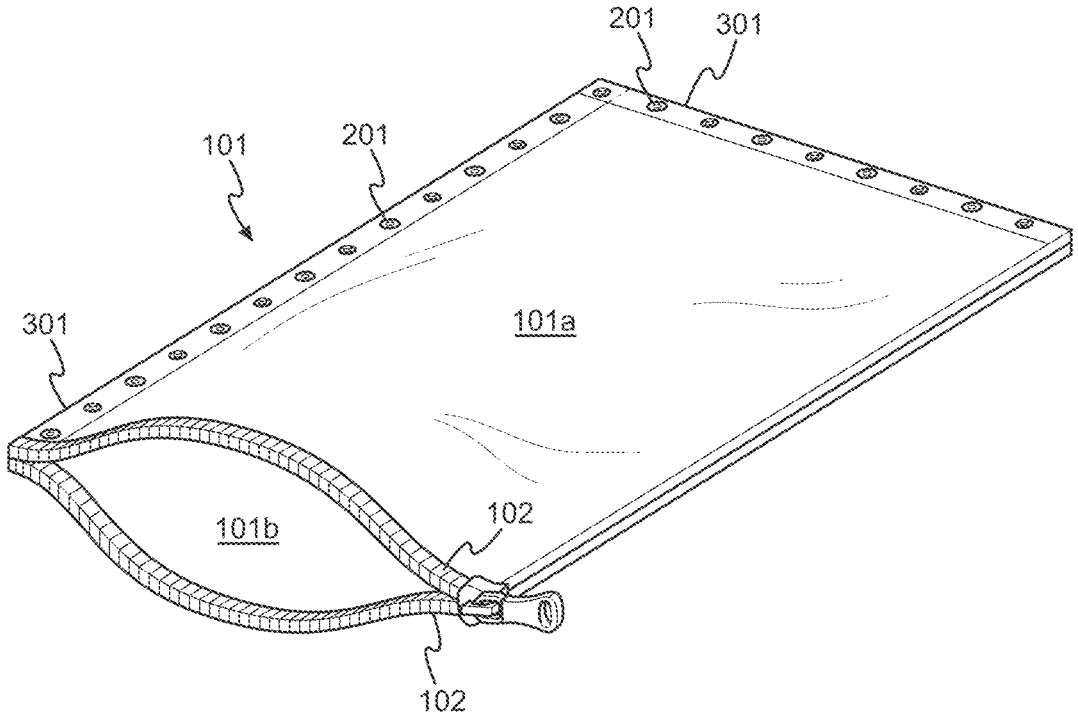
FIG. 3B shows a perspective view of one embodiment of one connectable blanket section having the connectors located on an exterior thereof.

Referring now to FIG. 3A and FIG. 3B, there is shown perspective views of embodiments where the connectors can be hidden on the interior of the blanket. When the connectable blanket sections 101 are separated from each other it is still part of the present invention that the blanket sections 101 may be used as a blanket. When used in this manner it may be undesirable for the connectors 201 to be located on the exterior of the connectable blanket section 101. Therefore, it is part of each connectable blanket section 101 that the section is reversable. Thus, the connectors 201 may be hidden on the inside of the connectable blanket section 101.

In order to allow the connects 201 to be hidden the connectable blanket sections 101 are reversible. This is created by having the first layer of material 101*a* as discussed in the description of FIG. 1, the second layer of material 101*b* as described in the description of FIG. 2A-FIG. 2D. When connected together the first layer of material 101*a* and the second layer of material 101*b* will create flaps 301. The flaps 301 will allow for the connectors 201 to be connected thereto. When turned inside out, or connector 201 side in, the flaps 301 will be located on the interior of the connectable blanket section 101. The closure device 102 may then be used to seal the connectable blanket section 101 closed. This will make sure that the connectable blanket section 101 remains inside out.

When connected to another connectable blanket section 101 the first connectable blanket section will be right side out, or connector 201 side out. The closure can then be used to seal the opening of the connectable blanket section 101. This will prevent the connectable blanket section 101 from having an opening or from turning inside out.

Figure 4A:
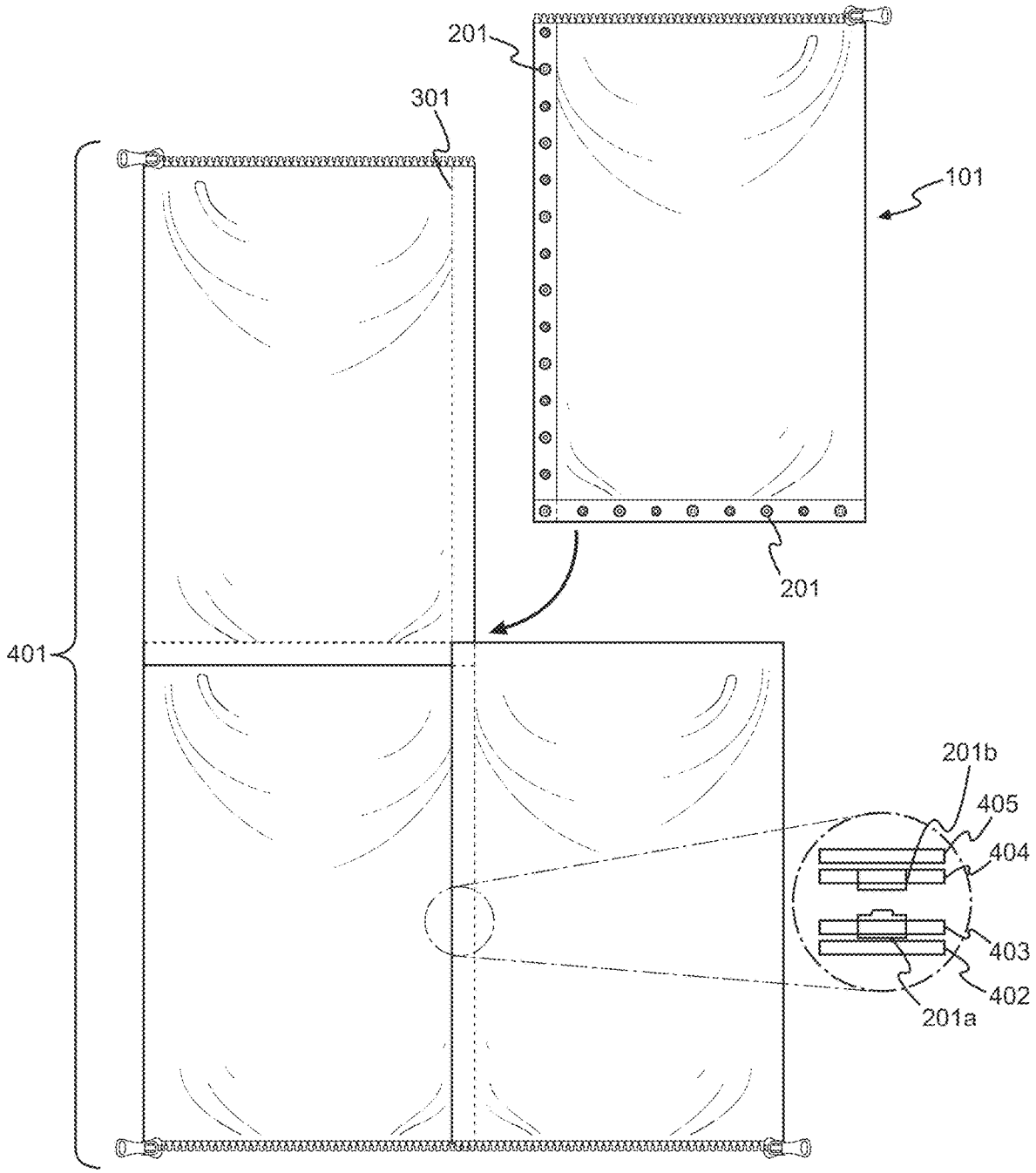
FIG. 4A shows a top-down view of an embodiment having three blanket sections connected and a fourth separated.
Figure 4B:
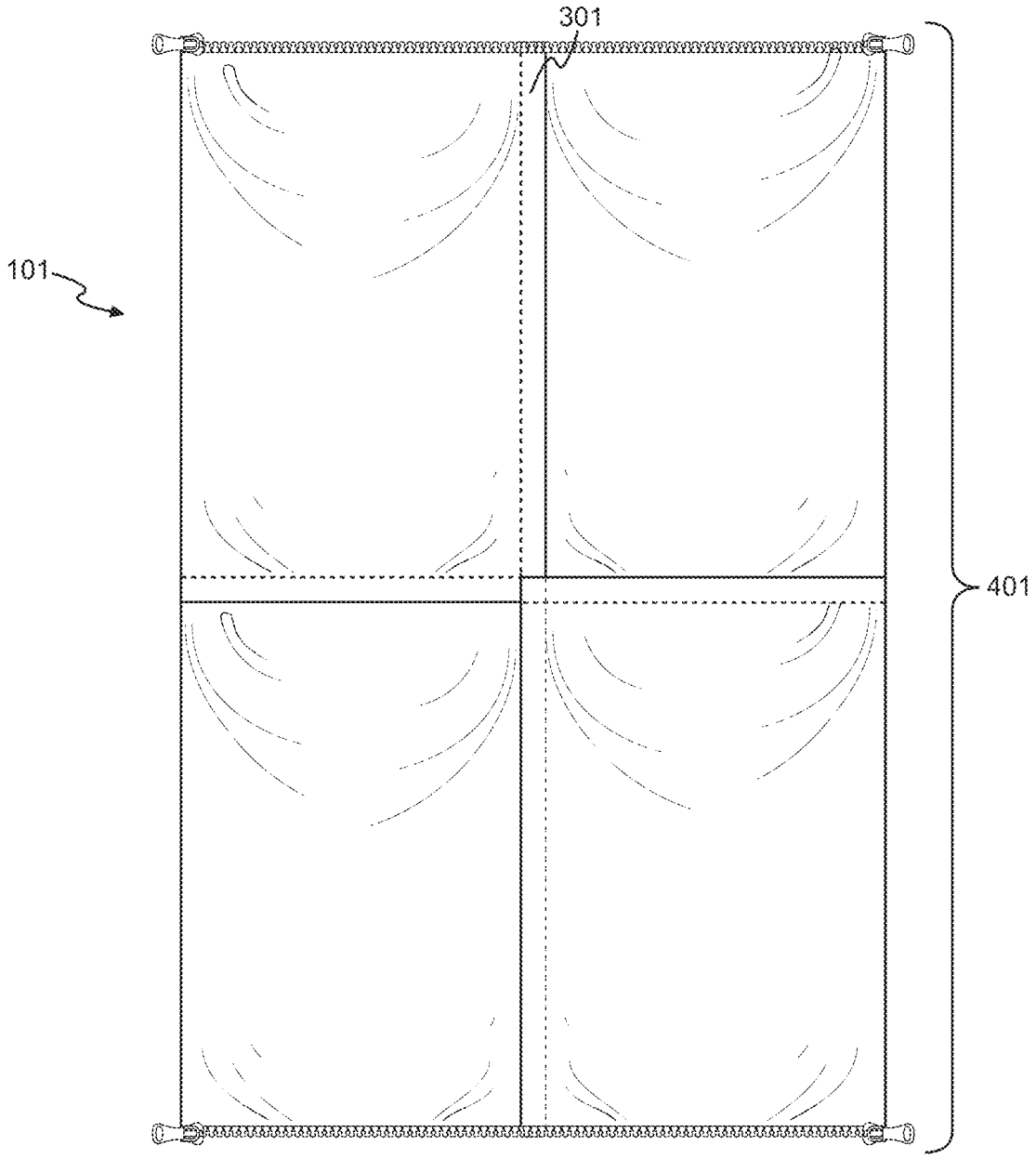
FIG. 4B shows top-down view of an embodiment having 4 blanket sections connected.

Referring now to FIG. 4A and FIG. 4B, there is shown top-down views of an embodiment of the connectable blanket sections being connected. In the shown embodiments there are four blanket sections 101. The four blanket sections 101 are connected together to form a larger connectable blanket 401. While FIG. 4A and FIG. 4B show the blanket sections 101 being connected together. However, in other embodiments the blanket sections 101 can be disconnected in the same manner.

In order to connect the connectable blanket sections 101 together one must align the connectors 201 and secure them together. In this embodiment the flap 301 will cover the connectors 201 once the connectable blanket sections 101 are secured together. In some embodiments such as the embodiment where the connectors 201 are buttons the buttons may be left exposed as a decorative item.

However, in other embodiments additional blanket section may be used. In order to add blanket sections 101 one of ordinary skill in the art will understand that additional connectors 102 will be needed located on additional sides. These additional connectors 102 will not depart from the present invention.

Specifically referring now to FIG. 4A, there is shown a call out which shows a cross sectional view of the connection area of two connectable blanket sections. For purposes of the following description a snap has been used as the chosen connector embodiment. A snap has a first half 201*a* and a second half 201*b*. In the shown call out the first half of the snap 201*a* is secured within a first connectable blanket section 403. Further, the second snap half 201*b* is secured within a second connectable blanket section 404.

In the shown embodiment an additional layer of material 402 is used to cover the first half of the snap 201*a*. This material 402 may be a full layer for the connectable blanket section or be present as a flap attached to the edge. Further, there is an additional lay of layer of material 405 is used to cover the second half of the snap 201*b*. This material 405 may be a full layer for the connectable blanket section 101 or be present as a flap 301 attached to the edge. Using these additional layers 402, 405 ensure that a user will not suffer discomfort from direct contact with the connectors 201.

Figure 5A:
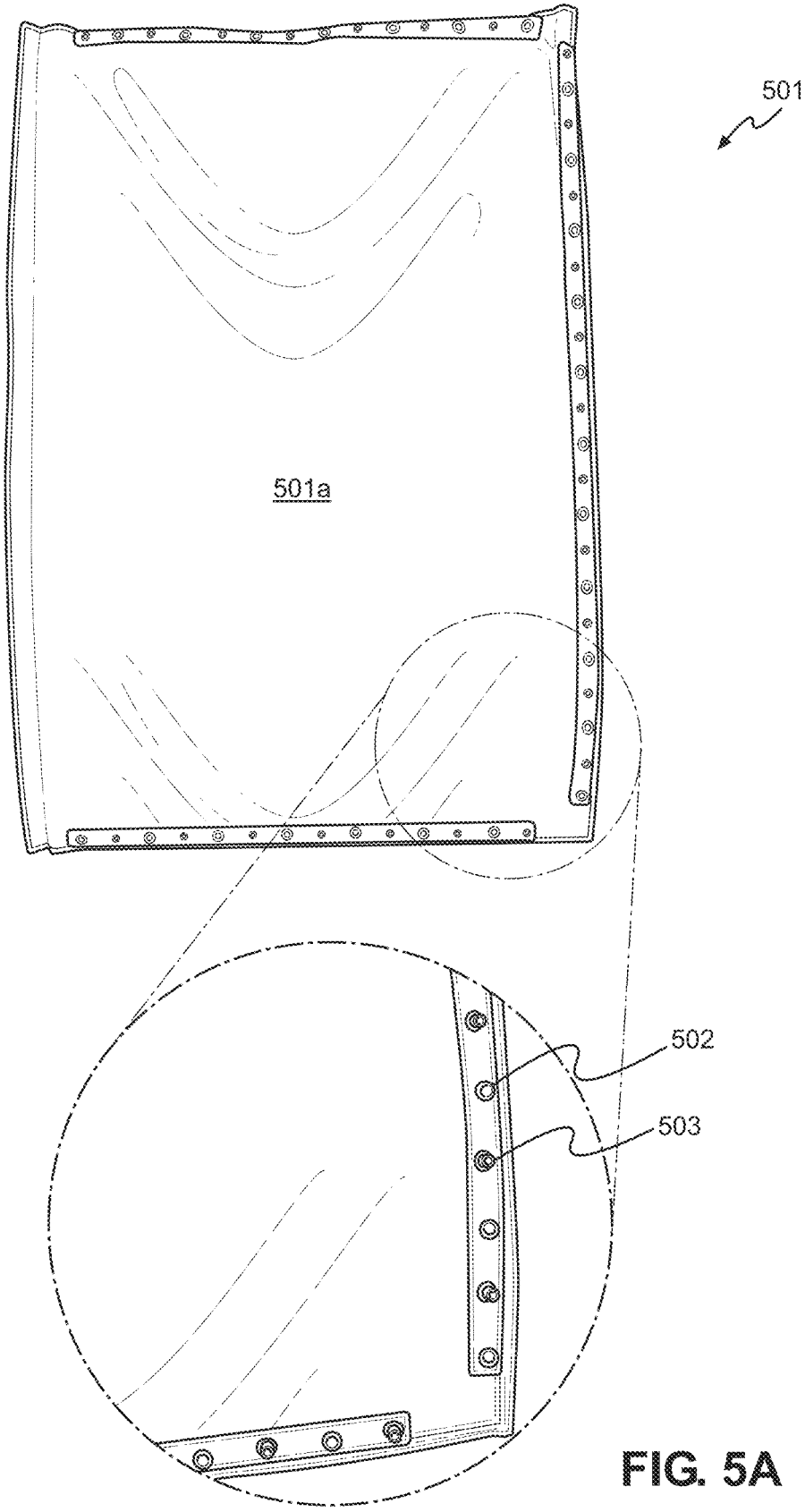
FIG. 5A shows a perspective view of a blanket section having connectors around the perimeter thereof.
Figure 5B:
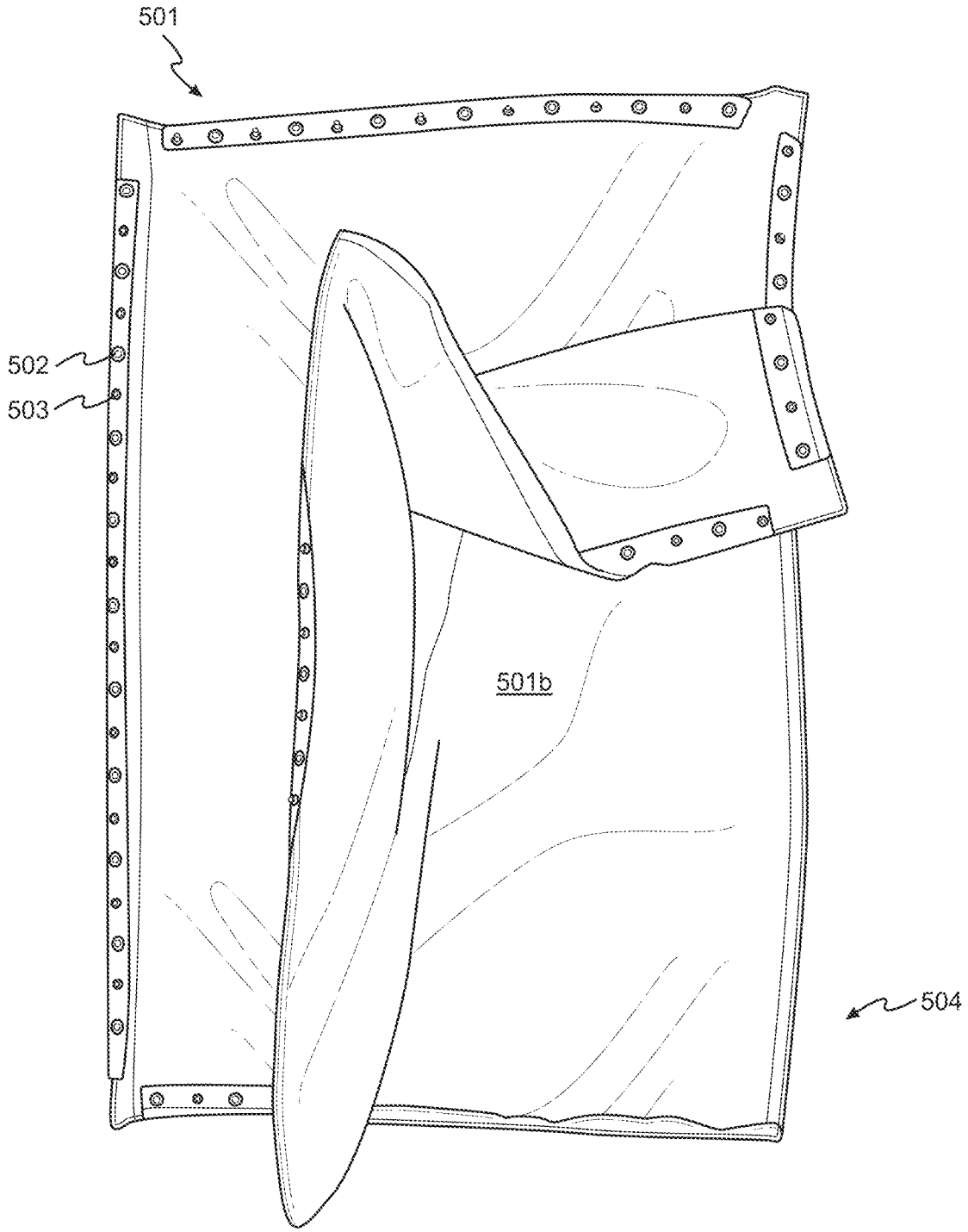
FIG. 5B shows a perspective view of two blanket sections having connectors around the perimeter thereof being secured together.
Figure 5C:
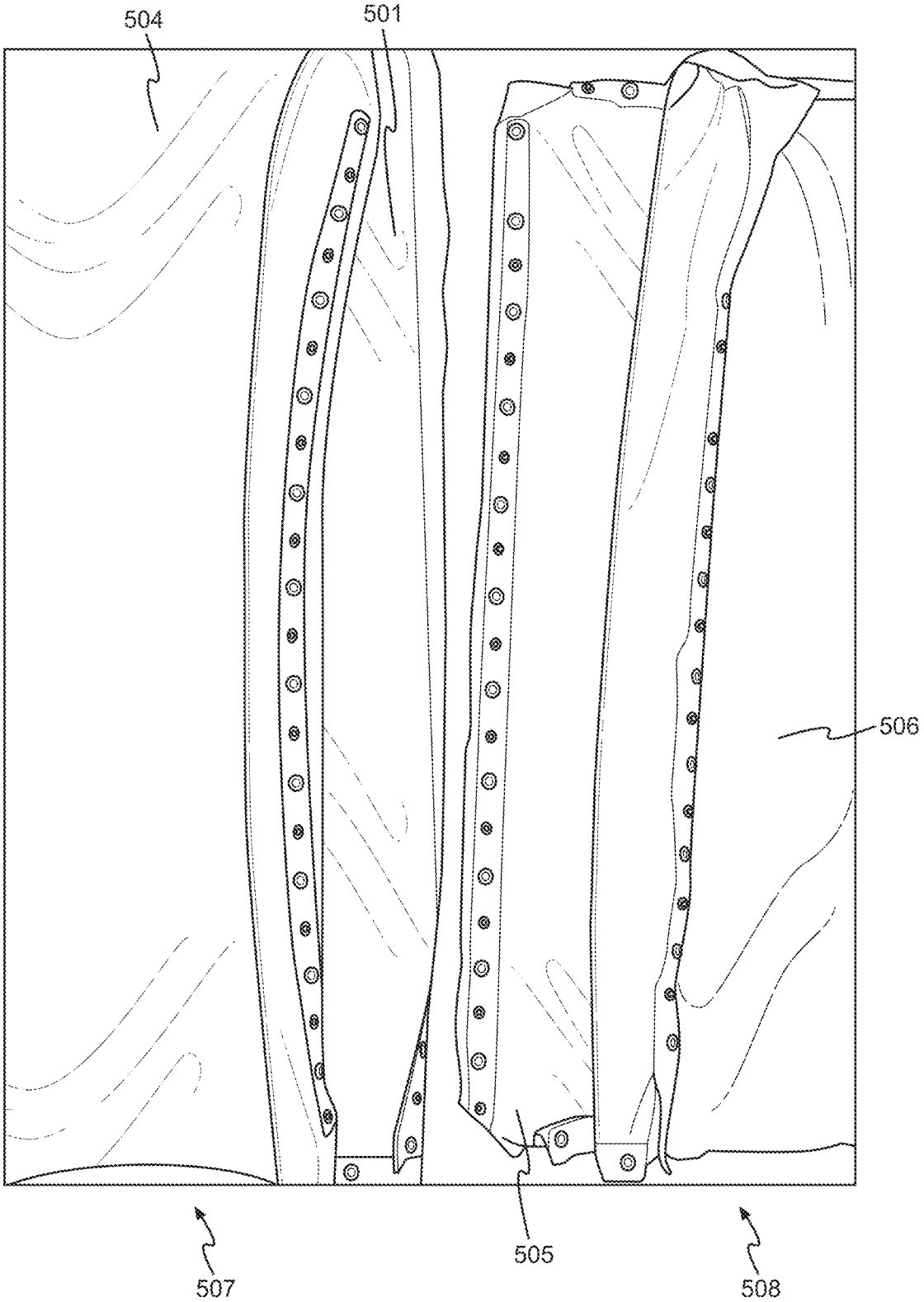
FIG. 5C shows a perspective view of four blanket sections having connectors around the perimeter thereof being secured together.

Referring now to FIG. 5A. FIG. 5B and FIG. 5C, there are shown several perspective views of at least one blanket section having connectors around the perimeter thereof. In the shown embodiment each blanket has only one layer. In some embodiments multiple layers may be used. These layers may provide various benefits such as insulation, waterproofing, or comfort. However, part of the genius of this design is that the blanket sections can be made such that they are functional with only a single layer of material.

Referring now to the first blanket section 501 of FIG. 5A. The first blanket section 501 is designed in a rectangular shape. However other geometric shapes may be used to accomplish the goals of the present invention. The first blanket section 501 has a plurality of connectors 502, 503 located around the perimeter thereof. In various embodiments different types of connectors may be used.

In one embodiment the connectors 502, 503 are hook and loop connectors. In another embodiment the connectors 502, 503 are magnetic connectors. In the shown embodiment the connectors 502, 503 are snaps. In the call out shown in FIG. 5A the snaps alternate. A first part of the snap 502 is placed followed by a second part of the snap 503 and onwards. This pattern will allow the various blanket sections to connect as described below.

In various embodiments the connectors 502, 503 may be placed in different configurations and still accomplish the same goals. However, in the shown embodiment the connectors 502, 503 are located on a first side 501*a* of the first blanket section 501 on three edges of the perimeter and on a second side 501*b* of fourth edge of the first blanket section 501.

The first blanket section 501 may be used by itself or with other blanket sections. When used by itself the first blanket section 501 is configured to be folded in half. When folded the snap connectors 502, 503 will align with the snap connectors of the side to be folded against it. This will allow for the first blanket section 501 to be connected together when folded in half. The edge of the first blanket section 501 having the snaps on the second side will be folded once more such that the connectors 502, 503 align and can be secured together. This will create a single blanket section with all of the connectors 502, 503 hidden from the outer surface.

Each of the other blanket sections 504, 505, 506 are constructed identically to the first blanket section 501. In different embodiments the various blanket sections may be connected together to create an enlarged blanket. Since the blanket sections are constructed identically there is no specific order or matching way in which the sections must be connected.

In one embodiment two of the blanket sections are secured together. For the sake of example, the blanket sections will be the first blanket section 501 and the second blanket section 504. When the first blanket section 501 is secured to the second blanket section 504 such that the edges with the snaps on the second sides of the blanket sections are placed opposite each other. The edges with the connectors 501 on the second sides are then folded toward the connectors of the corresponding side and secured. In this manner each of the connectors 501 are hidden from view and from the exterior side of the now single blanket.

In yet another embodiment four blanket sections may be connected together forming an even larger blanket. In this embodiment a first set of two blanket sections 507 and a second set of two blanket sections 508 are secured together. In order to secure the blanket sections together 507, 508 first one edge of each set must be disconnected. The edge which is disconnected should be one of the edges which has the folded portion having the connectors 502, 503 on the second side. These disconnected edges for each the first set 507 and the second set 508 may then be aligned and the connectors 502, 503 are secured together creating a single blanket of 4 individual blanket sections.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A connectable blanket section, the connectable blanket section comprising:

a first layer of material which is rectangular in shape; and a plurality of snaps placed along edges of the first layer of material;

wherein:

a portion of the plurality of snaps is placed on a first side of the first layer of material along three edges of the connectable blanket section, and another portion of the plurality of snaps is placed on a second side of the first layer of material only along a fourth edge of the connectable blanket section, each snap of the plurality of snaps is continuously positioned adjacent to at least one other snap of the plurality of snaps such that a female snap is positioned adjacent to a male snap, and the first layer of material further comprises at least one flap configured to conceal a rear side of each snap of the plurality of snaps, the at least one flap is configured to be folded along the fourth edge to place the plurality of snaps on the second side onto the first side.

2. The connectable blanket section of claim 1, wherein the plurality of snaps are configured to align when the connectable blanket section is folded in half.

3. The connectable blanket section of claim 1, wherein the plurality of snaps are configured such that the plurality of snaps are located on an interior of the connectable blanket section when the connectable blanket section is folded in half.

4. A connectable blanket section, the connectable blanket section comprising:

a first layer of material which is rectangular in shape; and a plurality of snaps placed along edges of the first layer of material;

wherein:

a portion of the plurality of snaps is placed on a first side of the first layer of material along three edges of the connectable blanket section, and another portion of the plurality of snaps is placed on a second side of the first layer of material only along a fourth edge of the connectable blanket section, each snap of the plurality of snaps is continuously positioned adjacent to at least one other snap of the plurality of snaps such that a female snap is positioned adjacent to a male snap, the connectable blanket section is configured to be connectable with at least two additional connectable blanket sections, the first layer of material further comprises at least one flap configured to conceal a rear side of each snap of the plurality of snaps, and the at least one flap is configured to be folded along the fourth edge to place the plurality of snaps on the second side onto the first side.

5. The connectable blanket section of claim 4, wherein the plurality of snaps are configured to align when the connectable blanket section is folded in half.

6. The connectable blanket section of claim 4, wherein the plurality of snaps are configured such that the plurality of snaps are located on an interior of the connectable blanket section when the connectable blanket section is folded in half.

* * * * *